US008449956B2

(12) United States Patent
Simpson et al.

(10) Patent No.: US 8,449,956 B2
(45) Date of Patent: May 28, 2013

(54) TRANSPARENT INK-JET RECORDING FILMS, COMPOSITIONS, AND METHODS

(75) Inventors: Sharon M. Simpson, Lake Elmo, MN (US); William D. Devine, Fort Collins, CO (US); William J. Ruzinsky, Loveland, CO (US)

(73) Assignee: Carestream Health, Inc., Rochester, NY (US)

( * ) Notice: Subject to any disclaimer, the term of this patent is extended or adjusted under 35 U.S.C. 154(b) by 0 days.

(21) Appl. No.: 13/230,877

(22) Filed: Sep. 13, 2011

(65) Prior Publication Data

US 2012/0231183 A1 Sep. 13, 2012

Related U.S. Application Data

(60) Provisional application No. 61/383,857, filed on Sep. 17, 2010.

(51) Int. Cl.
*B41M 5/00* (2006.01)

(52) U.S. Cl.
USPC ..... 428/32.12; 428/32.24; 428/32.25; 428/32.26; 428/32.27; 428/32.28; 428/32.31; 428/32.34

(58) Field of Classification Search
CPC .... B41M 5/0256; B41M 5/506; B41M 5/5218; B41M 5/52; B41M 5/5236
USPC ..... 428/32.12, 32.24, 32.25, 32.26, 32.27, 428/32.28, 32.31, 32.34
See application file for complete search history.

(56) References Cited

U.S. PATENT DOCUMENTS

| | | | | |
|---|---|---|---|---|
| 4,365,423 | A | 12/1982 | Arter et al. | |
| 5,795,708 | A | 8/1998 | Boutet | |
| 6,387,473 | B1 * | 5/2002 | Sismondi et al. | 428/32.34 |
| 6,630,283 | B1 | 10/2003 | Simpson et al. | |
| 2001/0014381 | A1 * | 8/2001 | Kaneko et al. | 428/195 |
| 2007/0231510 | A1 * | 10/2007 | Baker | 428/32.28 |
| 2008/0057232 | A1 * | 3/2008 | Leon et al. | 428/32.24 |

FOREIGN PATENT DOCUMENTS

| | | |
|---|---|---|
| EP | 1 211 088 | 6/2002 |
| JP | 2002-225424 | 8/2002 |

OTHER PUBLICATIONS

Sigma-Adlrich—Zonyl FSO, 2013.*
International Search Report, International Application No. PCT/US2011/051481, Oct. 24, 2011, 2 pages.
Commonly assigned—U.S. Appl. No. 13/176,788, "Transparent Ink-Jet Recording Films, Compositions, and Methods," by Simpson et al., filed Jul. 6, 2011.
Commonly assigned—U.S. Appl. No. 13/208,379, "Transparent Ink-Jet Recording Films, Compositions, and Methods" by Simpson et al., filed Aug. 12, 2011.
Commonly assigned—U.S. Appl. No. 61/415,954, "Transparent Ink-Jet Recording Films, Compositions, and Methods", by: Simpson et al., filed Nov. 22, 2010.
Commonly assigned—U.S. Appl. No. 61/490,619, "Transparent Ink-Jet Recording Films, Compositions, and Methods", by Simpson et al., filed May 27, 2011.
*Research Disclosure*, No. 308119, Dec. 1989, (available from Research Disclosure, 145 Main St., Ossining, NY, 10562), 46 pages.

* cited by examiner

*Primary Examiner* — Betelhem Shewareged
(74) *Attorney, Agent, or Firm* — Reed L. Christiansen

(57) ABSTRACT

Transparent ink-jet recording films, compositions, and methods are disclosed. Such films do not exhibit excessive ink drying times. These films exhibit high maximum optical densities and have low haze values. These films are useful for medical imaging.

13 Claims, No Drawings

TRANSPARENT INK-JET RECORDING FILMS, COMPOSITIONS, AND METHODS

CROSS REFERENCE TO RELATED APPLICATIONS

This application claims the benefit of U.S. Provisional Application No. 61/383,857, filed Sep. 17, 2010, entitled TRANSPARENT INK-JET RECORDING FILMS, COMPOSITIONS, AND METHODS, which is hereby incorporated by reference in its entirety.

TECHNICAL FIELD

This application relates to transparent ink-jet recording films, compositions, and methods.

SUMMARY

Transparent ink jet recording films often employ one or more image-receiving layers on one or both sides of a transparent support. In order to obtain high image densities when printing on transparent films, more ink is often applied than is required for opaque films. However, use of more ink can increase ink drying times, impacting ink jet printer throughput. The compositions and methods of the present application can provide transparent ink-jet recording films that do not exhibit excessive ink drying times. Such films can exhibit high maximum optical densities and low haze values.

At least some embodiments provide a transparent ink jet recording film comprising a transparent substrate, at least one under-layer comprising gelatin and at least one borate or borate derivative, and at least one image-receiving layer disposed on the at least one under-layer, where that at least one image-receiving layer comprises at least one inorganic particle, at least one water soluble or water dispersible polymer comprising at least one hydroxyl group, and nitric acid, and where at least one of the at least one under-layer or the at least one image-receiving layer comprises at least one first surfactant comprising at least one of a nonyl phenol, glycidyl polyether; a fluoroacrylic alcohol substituted polyethylene; a hydroxy-terminated fluorinated polyether; or a non-ionic fluorosurfactant. The at least one under-layer may comprise the at least one first surfactant, the at least one image-receiving layer may comprise the at least one first surfactant, or both the at least one under-layer and the at least one image-receiving layer may comprise the at least one first surfactant. In at least some embodiments, the at least one first surfactant comprises a nonyl phenol, glycidyl polyether. In at least some embodiments, the at least one first surfactant comprises a hydroxyl-terminated fluorinated polyether. In at least some embodiments, the at least one under-layer does not exhibit phase separation.

In some embodiments, the transparent ink-jet recording film further comprises at least one second surfactant different from the at least one first surfactant, where the at least one second surfactant comprises at least one of a nonyl phenol, glycidyl polyether; a fluoroacrylic alcohol substituted polyethylene; a hydroxy-terminated fluorinated polyether; or a non-ionic fluorosurfactant. In some cases, the at least one first surfactant and the at least one second surfactant may both be in the at least one under-layer, or they may both be in the at least one image-receiving layer, or the at least one first surfactant may be in the at least one under-layer and the at least one second surfactant may be in the at least one image-receiving layer.

In at least some embodiments, the at least one water soluble or water dispersible polymer comprises poly(vinyl alcohol).

In some cases, the at least one image-receiving layer comprises a dry coating weight of at least about 46 g/m$^2$. The at least one image-receiving layer may, in some cases, comprise from about 1 to about 2 g/m$^2$ of the at least one first surfactant on a dry basis.

In some cases, the at least one under-layer may comprise from about 0.001 to about 0.60 g/m$^2$ on a dry basis.

In at least some embodiments, such transparent ink-jet recording films exhibit haze/wetness regression slopes that have magnitude less than about 10% haze/wetness unit, or less than about 5% haze/wetness unit.

In at least some embodiments, such transparent ink-jet recording films exhibit wetness values below about 0.50 when imaged at 86% relative humidity with an EPSON® 4900 ink-jet printer at optical densities of at least 2.8, or wetness values below about 0.25 when imaged at 73% relative humidity with an EPSON® 4900 ink-jet printer at optical densities of at least 2.8.

These embodiments and other variations and modifications may be better understood from the detailed description, exemplary embodiments, examples, and claims that follow. Any embodiments provided are given only by way of illustrative example. Other desirable objectives and advantages inherently achieved may occur or become apparent to those skilled in the art. The invention is defined by the appended claims.

DETAILED DESCRIPTION

All publications, patents, and patent documents referred to in this document are incorporated by reference herein in their entirety, as though individually incorporated by reference.

U.S. Provisional Application No. 61/383,857, filed Sep. 17, 2010, entitled TRANSPARENT INK-JET RECORDING FILMS, COMPOSITIONS, AND METHODS, is hereby incorporated by reference in its entirety.

Introduction

An ink-jet recording film may comprise at least one image-receiving layer, which receives ink from an ink jet printer during printing, and a substrate or support, which may be opaque or transparent. An opaque support may be used in films that may be viewed using light reflected by a reflective backing, while a transparent support may be used in films that may be viewed using light transmitted through the film.

Some medical imaging applications require high image densities. For a reflective film, high image densities may be achieved by virtue of the light being absorbed on both its path into the imaged film and again on the light's path back out of the imaged film from the reflective backing. On the other hand, for a transparent film, because of the lack of a reflective backing, achievement of high image densities may require application of larger quantities of ink than are common for opaque films.

Transparent Ink-Jet Films

Transparent ink jet recording films are known in the art. See, for example, U.S. patent application Ser. No. 13/176,788, "TRANSPARENT INK-JET RECORDING FILMS, COMPOSITIONS, AND METHODS," by Simpson et al., filed Jul. 6, 2011, and U.S. patent application Ser. No. 13/208,379, "TRANSPARENT INK-JET RECORDING FILMS, COMPOSITIONS, AND METHODS" by Simpson et al., filed Aug. 12, 2011, both of which are herein incorporated in their entirety.

Transparent ink jet recording films may comprise one or more transparent substrates upon which at least one under-layer may be coated. Such an under-layer may optionally be dried before being further processed. The film may further comprise one or more image-receiving layers coated upon at least one under-layer. Such an image-receiving layer is generally dried after coating. The film may optionally further comprise additional layers, such as one or more backing layers or overcoat layers, as will be understood by those skilled in the art.

One performance characteristic of transparent ink-jet recording films is the total light transmittance, particularly the extent to which films exhibit haze. Percent haze may, for example, be measured in accord with ASTM D 1003 by conventional means using a HAZE-GARD PLUS Hazeometer that is available from BYK-Gardner (Columbia, Md.).

Another performance characteristic of transparent ink-get recording films is their drying performance expressed, for example, in terms of wetness percentages and wetness values. Wetness values may be determined by imaging coated films with an ink-jet printer equipped with a Wasatch Raster Image Processor, using a 17-step grey scale image having a maximum optical density of at least 2.8. Immediately after the film exits the printer, the ink-jet image may be turned over and placed over a piece of white paper. The fraction of each wedge that is wet may be recorded by sequential wedge number, with wedge 1 being the wedge having the maximum optical density and wedge 17 being the wedge having the minimum optical density. The percent of wet ink on the wedge having the maximum optical density is referred to as a "wetness percentage," which has a value of 0% for a completely dry wedge and a value of 100% for a completely wet wedge. Wetness values may be constructed from wetness percentage data by taking the largest wedge number for the set of completely wet wedges and adding it to the fractional wetness of the adjacent wedge with the next highest wedge number. For example, if wedges 1 and 2 were completely wet and wedge 3 was 25% wet, the wetness value would be 2.25. Or if no wedges were completely wet, but wedge 1 was 75% wet, the wetness value would be 0.75.

Use of surfactants to improve film ink-drying performance can also have the side effect of increasing film haze. The relative effectiveness of surfactants in this role may be compared by making a series of coated films having a range of surfactant levels in one or more of the under-layers or image-receiving layers and measuring the percent haze and wetness value for each film. Linear regression may be applied to these data, using "% haze" as the regressand and "wetness value" as the regressor. The magnitude of the negative slope of the resulting regression line represents the increase in % haze seen when reducing the wetness value by one unit. Slopes with smaller magnitudes reflect smaller haze generation, while more negative slopes reflect greater haze generation, for the same extent of ink-drying improvement. Surfactants exhibiting smaller slope magnitudes are more effective in this role than those with larger (more negative) slope magnitudes.

Under-Layer Coating Mix

Under-layers may be formed by applying at least one under-layer coating mix to one or more transparent substrates. The under-layer formed may, in some cases, comprise at least about 2.9 g/m$^2$ solids on a dry basis, or at least about 3.0 g/m$^2$ solids on a dry basis, or at least about 3.5 g/m$^2$ solids on a dry basis, or at least about 4.0 g/m$^2$ solids on a dry basis, or at least about 4.2 g/m$^2$ solids on a dry basis, or at least about 5.0 g/m$^2$ solids on a dry basis, or at least about 5.4 g/m$^2$ solids on a dry basis, or at least about 5.8 g/m$^2$ solids on a dry basis. The under-layer coating mix may comprise gelatin. In at least some embodiments, the gelatin may be a Regular Type IV bovine gelatin. The under-layer coating mix may further comprise at least one borate or borate derivative, such as, for example, sodium borate, sodium tetraborate, sodium tetraborate decahydrate, boric acid, phenyl boronic acid, butyl boronic acid, and the like. More than one type of borate or borate derivative may optionally be included in the under-layer coating mix. In some embodiments, the borate or borate derivative may be used in an amount of up to, for example, about 2 g/m$^2$. In at least some embodiments, the ratio of the at least one borate or borate derivative to the gelatin may be between about 20:80 and about 1:1 by weight, or the ratio may be about 0.45:1 by weight. In some embodiments, the under-layer coating mix may comprise, for example, at least about 4 wt % solids, or at least about 9.2 wt % solids. The under-layer coating mix may comprise, for example, about 15 wt % solids.

The under-layer coating mix may also optionally comprise other components, such as surfactants, such as, for example, a nonyl phenol, glycidyl polyether; a fluoroacrylic alcohol substituted polyethylene; a hydroxy-terminated fluorinated polyether; or a non-ionic fluorosurfactant. In some embodiments, such a surfactant may be used in amount from about 0.001 to about 0.60 g/m$^2$ on a dry basis, as measured in the under-layer. In some embodiments, the under-layer coating mix may optionally further comprise a thickener, such as, for example, a sulfonated polystyrene. These and other optional mix components will be understood by those skilled in the art.

Image-Receiving Layer Coating Mix

Image-receiving layers may be formed by applying at least one image-receiving layer coating mix to one or more under-layer coatings. The image-receiving layer formed may, in some cases, comprise at least about 40 g/m$^2$ solids on a dry basis, or at least about 41.3 g/m$^2$ solids on a dry basis, or at least about 45 g/m$^2$ solids on a dry basis, or at least about 46 g/m$^2$ on a dry basis, or at least about 49 g/m$^2$ solids on a dry basis. The image-receiving coating mix may comprise at least one water soluble or dispersible cross-linkable polymer comprising at least one hydroxyl group, such as, for example, poly(vinyl alcohol), partially hydrolyzed poly(vinyl acetate/vinyl alcohol), copolymers containing hydroxyethylmethacrylate, copolymers containing hydroxyethylacrylate, copolymers containing hydroxypropylmethacrylate, hydroxy cellulose ethers, such as, for example, hydroxyethylcellulose, and the like. More than one type of water soluble or water dispersible cross-linkable polymer may optionally be included in the under-layer coating mix. In some embodiments, the at least one water soluble or water dispersible polymer may be used in an amount of up to about 1.0 to about 4.5 g/m$^2$, as measured in the image-receiving layer.

The image-receiving layer coating mix may also comprise at least one inorganic particle, such as, for example, metal oxides, hydrated metal oxides, boehmite alumina, clay, calcined clay, calcium carbonate, aluminosilicates, zeolites, barium sulfate, and the like. Non-limiting examples of inorganic particles include silica, alumina, zirconia, and titania. Other non-limiting examples of inorganic particles include fumed silica, fumed alumina, and colloidal silica. In some embodiments, fumed silica or fumed alumina have primary particle sizes up to about 50 nm in diameter, with aggregates being less than about 300 nm in diameter, for example, aggregates of about 160 nm in diameter. In some embodiments, colloidal silica or boehmite alumina have particle size less than about 15 nm in diameter, such as, for example, 14 nm in diameter. More than one type of inorganic particle may optionally be included in the image-receiving coating mix.

In at least some embodiments, the ratio of inorganic particles to polymer in the at least one image-receiving layer coating mix may be, for example, between about 88:12 and about 95:5 by weight, or the ratio may be about 92:8 by weight.

Image-receiving layer coating layer mixes prepared from alumina mixes with higher solids fractions can perform well in this application. However, high solids alumina mixes can, in general, become too viscous to be processed. It has been discovered that suitable alumina mixes can be prepared at, for example, 25 wt % or 30 wt % solids, where such mixes comprise alumina, nitric acid, and water, and where such mixes comprise a pH below about 3.09, or below about 2.73, or between about 2.17 and about 2.73. During preparation, such alumina mixes may optionally be heated, for example, to 80° C.

The image-receiving coating layer mix may also comprise one or more surfactants such as, for example, a nonyl phenol, glycidyl polyether; a fluoroacrylic alcohol substituted polyethylene; a hydroxy-terminated fluorinated polyether; or a non-ionic fluorosurfactant. In some embodiments, such a surfactant may be used in amount of, for example, from about 1 to about 2 $g/m^2$ on a dry basis, or about 1.5 $g/m^2$ on a dry basis, as measured in the image-receiving layer. In some embodiments, the image-receiving coating layer may also optionally comprise one or more acids, such as, for example, nitric acid.

These and components may optionally be included in the image-receiving coating layer mix, as will be understood by those skilled in the art.

Transparent Substrate

Some embodiments provide transparent ink-jet films comprising transparent substrates. Such transparent substrates are generally capable of transmitting visible light without appreciable scattering or absorption. For example, such transparent substrates may allow transmission of at least about 80% of visible light, or of at least about 85% of visible light, or of at least about 90% of visible light, or of at least about 95% of visible light.

Transparent substrates may be flexible, transparent films made from polymeric materials, such as, for example, polyethylene terephthalate, polyethylene naphthalate, cellulose acetate, other cellulose esters, polyvinyl acetal, polyolefins, polycarbonates, polystyrenes, and the like. In some embodiments, polymeric materials exhibiting good dimensional stability may be used, such as, for example, polyethylene terephthalate, polyethylene naphthalate, other polyesters, or polycarbonates.

Other examples of transparent substrates are transparent, multilayer polymeric supports, such as those described in U.S. Pat. No. 6,630,283 to Simpson, et al., which is hereby incorporated by reference in its entirety. Still other examples of transparent supports are those comprising dichroic mirror layers, such as those described in U.S. Pat. No. 5,795,708 to Boutet, which is hereby incorporated by reference in its entirety.

Transparent substrates may optionally contain colorants, pigments, dyes, and the like, to provide various background colors and tones for the image. For example, a blue tinting dye is commonly used in some medical imaging applications. These and other components may optionally be included in the transparent substrate, as will be understood by those skilled in the art.

In some embodiments, the transparent substrate may be provided as a continuous or semi-continuous web, which travels past the various coating, drying, and cutting stations in a continuous or semi-continuous process.

Coating

The at least one under-layer and at least one image-receiving layer may be coated from mixes onto the transparent substrate. The various mixes may use the same or different solvents, such as, for example, water or organic solvents. Layers may be coated one at a time, or two or more layers may be coated simultaneously. For example, simultaneously with application of an under-layer coating mix to the support, an image-receiving layer may be applied to the wet under-layer using such methods as, for example, slide coating.

Layers may be coated using any suitable methods, including, for example, dip-coating, wound-wire rod coating, doctor blade coating, air knife coating, gravure roll coating, reverse-roll coating, slide coating, bead coating, extrusion coating, curtain coating, and the like. Examples of some coating methods are described in, for example, *Research Disclosure*, No. 308119, December 1989, pp. 1007-08, (available from Research Disclosure, 145 Main St., Ossining, N.Y., 10562, http://www.researchdisclosure.com), which is hereby incorporated by reference in its entirety.

Drying

Coated layers, such as, for example under-layers or image-receiving layers, may be dried using a variety of known methods. Examples of some drying methods are described in, for example, *Research Disclosure*, No. 308119, December 1989, pp. 1007-08, (available from Research Disclosure, 145 Main St., Ossining, N.Y., 10562, http://www.researchdisclosure.com), which is hereby incorporated by reference in its entirety. In some embodiments, coating layers may be dried as they travel past one or more perforated plates through which a gas, such as, for example, air or nitrogen, passes. Such an impingement air dryer is described in U.S. Pat. No. 4,365,423 to Arter et al., which is incorporated by reference in its entirety. The perforated plates in such a dryer may comprise perforations, such as, for example, holes, slots, nozzles, and the like. The flow rate of gas through the perforated plates may be indicated by the differential gas pressure across the plates. The ability of the gas to remove water may be limited by its dew point, while its ability to remove organic solvents may be limited by the amount of such solvents in the gas, as will be understood by those skilled in the art.

In some embodiments, the under-layer may be dried by exposure to ambient air. Image-receiving layers may be dried by exposure to air at, for example, 85° C. for 10 min in a Blue M Oven.

EXEMPLARY EMBODIMENTS

U.S. Provisional Application No. 61/383,857, filed Sep. 17, 2010, which is hereby incorporated by reference in its entirety, disclosed the following nine non-limiting exemplary embodiments:

A. A transparent ink-jet recording film comprising:

a transparent substrate;

at least one under-layer comprising gelatin and at least one borate or borate derivative; and at least one image-receiving layer disposed on the at least one under-layer, said at least one image-receiving layer comprising at least one water soluble or water dispersible polymer comprising at least one hydroxyl group, wherein at least one of the at least one under-layer or the at least one image-receiving layer comprises at least one first surfactant comprising at least one of a nonyl phenol, glycidyl polyether; a fluoroacrylic alcohol substituted polyethylene; a perfluoro methacrylic copolymer; a fluoroaliphatic copolymer; a hydroxy-terminated fluorinated polyether; or a non-ionic fluorosurfactant.

B. The transparent ink-jet recording film according to embodiment A, wherein the at least one under-layer comprises the at least one first surfactant.

C. The transparent ink-jet recording film according to embodiment A, wherein the at least one image-receiving layer comprises the at least one first surfactant.

D. The transparent ink-jet recording film according to embodiment A, wherein the at least one under-layer and the at least one image-receiving layer both comprise the at least one first surfactant.

E. The transparent ink-jet recording film according to embodiment A, further comprising at least one second surfactant comprising at least one of a nonyl phenol, glycidyl polyether; a fluoroacrylic alcohol substituted polyethylene; a perfluoro methacrylic copolymer; a fluoroaliphatic copolymer; a hydroxy-terminated fluorinated polyether; or a non-ionic fluorosurfactant, wherein the at least one first surfactant and the at least one second surfactant are not the same.

F. The transparent ink jet recording film according to embodiment E, wherein the at least one under-layer comprises the at least one first surfactant and the at least one image-receiving layer comprises the at least one second surfactant.

G. The transparent ink-jet recording film according to embodiment A, wherein the at least one under-layer does not exhibit phase separation.

H. The transparent ink-jet recording film according to embodiment A, wherein the at least one first surfactant comprises a nonyl phenol, glycidyl polyether.

I. The transparent ink-jet recording film according to embodiment A, wherein the at least one first surfactant comprises a hydroxy-terminated fluorinated polyether.

EXAMPLES

Materials

Materials used in the examples were available from Aldrich Chemical Co., Milwaukee, unless otherwise specified.

Boehmite is an aluminum oxide hydroxide (γ-AlO(OH)).

Borax is sodium tetraborate decahydrate.

CELVOL® 540 is a poly(vinyl alcohol) that is 87-89.9% hydrolyzed, with 140,000-186,000 weight-average molecular weight. It is available from Sekisui Specialty Chemicals America, LLC, Dallas, Tex.

DISPERAL® HP-14 is a dispersible boehmite alumina powder with high porosity and a particle size of 14 nm. It is available from Sasol North America, Inc., Houston, Tex.

Gelatin is a Regular Type IV bovine gelatin. It is available as Catalog No. 8256786 from Eastman Gelatine Corporation, Peabody, Mass.

KATHON® LX is a microbiocide. It is available from Dow Chemical.

MASURF® FP-420 is a 20% fluoroaliphatic copolymer in 7% dipropyl glycol and 73% water. It is available from Mason Chemical, Arlington Heights, Ill.

PF-159 is a 100% hydroxy-terminated fluorinated polyether. It is available from BASF Chemical, Florham Park, N.J.

Surfactant 10G is an aqueous solution of nonyl phenol, glycidyl polyether. It is available from Dixie Chemical Co., Houston, Tex.

VERSA-TL® 502 is a sulfonated polystyrene (1,000,000 molecular weight). It is available from AkzoNobel.

ZONYL® 8740 is a 30% solids perfluoro methacrylic copolymer aqueous dispersion. It is available from DuPont Chemical Solutions Enterprise, Wilmington, Del.

ZONYL® FSN is a 40% solution of a non-ionic fluorosurfactant in 30% isopropyl alcohol and 30% water. It is available from DuPont Chemical Solutions Enterprise, Wilmington, Del.

ZONYL® FS-300 is a 40% solids fluoroacrylic alcohol substituted polyethylene glycol in water. It is available from DuPont Chemical Solutions Enterprise, Wilmington, Del.

Coated Film Evaluation Methods

Coated films were imaged with an EPSON® 7900 ink-jet printer for Examples 1-71 (or with an EPSON® 4900 ink-jet printer for Example 72) using a Wasatch Raster Image Processor (RIP). A grey scale image was created by a combination of photo black, light black, light light black, magenta, light magenta, cyan, light cyan, and yellow EPSON® inks that were supplied with the printer. Samples were printed with a 17-step grey scale wedge having a maximum optical density of at least 2.8, as measured using a calibrated X-RITE® Model DTP 41 Spectrophotometer (X-Rite, Inc., Grandville, Mich.) in transmission mode.

Immediately after the film exited the printer, the ink-jet image was turned over and placed over a piece of white paper. The fraction of each wedge that was wet was recorded by sequential wedge number, with wedge 1 being the wedge having the maximum optical density and wedge 17 being the wedge with the minimum optical density. The percent of wet ink on the wedge having the maximum optical density is referred to as a "wetness percentage," which has a value of 0% for a completely dry wedge and a value of 100% for a completely wet wedge.

Wetness values were constructed from wetness percentage data by taking the largest wedge number for the set of completely wet wedges and adding it to the fractional wetness of the adjacent wedge with the next highest wedge number. For example, if wedges 1 and 2 were completely wet and wedge 3 was 25% wet, the wetness value would be 2.25. Or if no wedges were completely wet, but wedge 1 was 75% wet, the wetness value would be 0.75.

Haze (%) was measured in accord with ASTM D 1003 by conventional means using a HAZE-GARD PLUS Hazeometer that is available from BYK-Gardner (Columbia, Md.). All samples within each grouped set of Examples were coated onto the same lot of transparent substrate.

Example 1

Preparation of Under-Layer Coating Mix

A master batch was first prepared. To a mixing vessel, 257.75 g of deionized water was introduced. 12.60 g of gelatin was added to the agitated vessel and allowed to swell. This mix was heated to 60° C. and held until the gelatin was fully dissolved. The mix was then cooled to 50° C. To this mix, 5.67 g of borax (sodium tetraborate decahydrate) was added and mixed until the borax was fully dissolved. To this mix, 19.69 g of an aqueous solution of 3.2 wt % sulfonated polystyrene (VERSA-TL® 502, AkzoNobel) and 0.2 wt % microbiocide (KATHON® LX, Dow) was added and mixed until homogeneous. The mix was then cooled to 40° C. for use as a master batch.

To a 19.71 g aliquot of this master batch, 0.29 g of deionized water was added and mixed to form the under-layer coating mix. This mix was maintained at 40° C. for coating.

Preparation of Under-Layer Coated Substrates

Blue 7 mil polyethylene terephthalate substrates were knife-coated at room temperature with the under-layer coating mix, using a wet coating gap of 3.5 mils. The under-layer coatings were dried at room temperature. The resulting under-layer coatings had 6.30 wt % solids and a weight ratio of borax to gelatin of 0.45:1.

Preparation of Alumina Mix

A nominal 20 wt % alumina mix was prepared at room temperature by mixing 4.62 g of a 22 wt % aqueous solution of nitric acid and 555.38 g of deionized water. To this mix, 140 g of alumina powder (DISPERAL® HP-14, Sasol) was added over 30 min. The pH of the mix was adjusted to 3.25 by adding additional nitric acid solution. The mix was heated to 80° C.

and stirred for 30 min. The mix was cooled to room temperature and held for gas bubble disengagement prior to use.

Preparation of Image-Receiving Layer Coating Mix

An nominal 18 wt % solids image-receiving coating mix was prepared at room temperature by introducing 7.13 g of a 10 wt % aqueous solution of poly(vinyl alcohol) (CELVOL® 540, Sekisui) into a mixing vessel and agitating. To this mix, 41.00 g of the alumina mix, 0.66 g of a 10 wt % aqueous solution of nonyl phenol, glycidyl polyether (Surfactant 10G, Dixie), and 1.00 g of deionized water were added. The resulting image-receiving layer coating mix had an inorganic particle to polymer weight ratio of 92:8.

Preparation of Image-Receiving Layer Coated Films

The nominal 18 wt % solids image-receiving layer coating mix was knife-coated at room temperature onto two under-layer coated substrates, using a coating gap of 12 mils. The coated films were dried at 50° C. for 10 min in a Blue M Oven.

Example 2

The procedure of Example 1 was replicated.

Example 3

Preparation of Under-Layer Coating Mix

To a 19.71 g aliquot of the master batch of Example 1, 0.29 g of a 10 wt % aqueous solution of nonyl phenol, glycidyl polyether (Surfactant 10G, Dixie) was then added and mixed until homogeneous. This mix was maintained at 40° C. for coating.

Preparation of Under-Layer Coated Substrates

Under-layer coated substrates were prepared from this under-layer coating mix according to the procedure of Example 1. The resulting under-layer coatings had 6.44 wt % solids and a weight ratio of borax to gelatin of 0.45:1.

Image-Receiving Layer Coated Films

Image-Receiving layer coated films were prepared from these under-layer coated substrates according to the procedure of Example 1.

Example 4

Preparation of Under-Layer Coating Mix

To a 19.71 g aliquot of the master batch of Example 1, 0.58 g of a 10 wt % aqueous solution of nonyl phenol, glycidyl polyether (Surfactant 10G, Dixie) was then added and mixed until homogeneous. This mix was maintained at 40° C. for coating.

Preparation of Under-Layer Coated Substrates

Under-layer coated substrates were prepared from this under-layer coating mix according to the procedure of Example 1. The resulting under-layer coatings had 6.51 wt % solids and a weight ratio of borax to gelatin of 0.45:1.

Image-Receiving Layer Coated Films

Image-Receiving layer coated films were prepared from these under-layer coated substrates according to the procedure of Example 1.

Example 5

Preparation of Under-Layer Coating Mix and Under-Layer Coated Substrates

An under-layer coating mix and under-layer coated substrates were prepared according to the procedure of Example 3.

Preparation of Image-Receiving Layer Coating Mix

An nominal 17.9 wt % solids image-receiving coating mix was prepared at room temperature by introducing 7.13 g of a 10 wt % aqueous solution of poly(vinyl alcohol) (CELVOL® 540, Sekisui) into a mixing vessel and agitating. To this mix, 41.00 g of an alumina mix prepared according to the procedure of Example 1 and 1.66 g of deionized water were added. The resulting image-receiving layer coating mix had an inorganic particle to polymer weight ratio of 92:8.

Image-Receiving Layer Coated Films

Image-Receiving layer coated films were prepared from these under-layer coated substrates and image-receiving layer coating mix according to the procedure of Example 1.

Example 6

Preparation of Under-Layer Coated Substrates

An under-layer coating mix and under-layer coated substrates were prepared according to the procedure of Example 4.

Image-Receiving Layer Coated Films

Image-Receiving layer coated films were prepared from these under-layer coated substrates according to the procedure of Example 5.

Example 7

The coated films of Examples 1-6 were evaluated as described above, by ink-jet printing at 87-88% relative humidity. Samples 1-1, 2-1, 3-1, 4-1, 5-1, and 6-1 were printed and evaluated as a group. Several days later, Samples 1-2, 2-2, 3-2, 4-2, 5-2, and 6-2 were printed and evaluated as a group. Results are summarized in Table I.

The presence of surfactant at these levels in both the under-layer and image-receiving layer was associated with the highest haze values. The absence of surfactant from the image-receiving layer was associated with the lowest haze values.

The presence of surfactant at these levels in both the under-layer and image-receiving layer was associated with the best drying performance. The absence of surfactant from the image-receiving layer was associated with the worst drying performance.

Example 8

Preparation of Under-Layer Coating Mix

A master batch and an under-layer coating mix were prepared according to the procedure of Example 1.

Preparation of Under-Layer Coated Substrates

Under-layer coated substrates were prepared from this under-layer coating mix according to the procedure of Example 1. The resulting under-layer coatings had 6.30 wt % solids and a weight ratio of borax to gelatin of 0.45:1.

Preparation of Image-Receiving Layer Coating Mix

An nominal 17.9 wt % solids image-receiving coating mix was prepared at room temperature by introducing 7.13 g of a 10 wt % aqueous solution of poly(vinyl alcohol) (CELVOL® 540, Sekisui) into a mixing vessel and agitating. To this mix, 41.00 g of an alumina mix prepared according to the procedure of Example 1 and 1.66 g of deionized water were added. The resulting image-receiving layer coating mix had an inorganic particle to polymer weight ratio of 92:8.

Preparation of Image-Receiving Layer Coated Films

The nominal 17.9 wt % solids image-receiving layer coating mix was knife-coated at room temperature onto the under-layer coated substrates, using a coating gap of 12 mils. The coated films were dried at 50° C. for 10 min in a Blue M Oven.

Example 9

Preparation of Under-Layer Coating Mix

To a 19.71 g aliquot of the master batch of Example 8, 0.58 g of a 10 wt % aqueous solution of a 40% fluoroacrylic alcohol substituted polyethylene in water (ZONYL® FS-300, DuPont) was then added and mixed until homogeneous. This mix was maintained at 40° C. for coating.

Preparation of Under-Layer Coated Substrates

Under-layer coated substrates were prepared from this under-layer coating mix according to the procedure of Example 1. The resulting under-layer coatings had 6.49 wt % solids and a weight ratio of borax to gelatin of 0.45:1.

Image-Receiving Layer Coated Films

Image-Receiving layer coated films were prepared from these under-layer coated substrates according to the procedure of Example 8.

Example 10

Preparation of Under-Layer Coating Mix

To a 19.71 g aliquot of the master batch of Example 8, 0.29 g of a 10 wt % aqueous solution of a 40% fluoroacrylic alcohol substituted polyethylene in water (ZONYL® FS-300, DuPont) was then added and mixed until homogeneous. This mix was maintained at 40° C. for coating.

Preparation of Under-Layer Coated Substrates

Under-layer coated substrates were prepared from this under-layer coating mix according to the procedure of Example 1. The resulting under-layer coatings had 6.44 wt % solids and a weight ratio of borax to gelatin of 0.45:1.

Preparation of Image-Receiving Layer Coating Mix

An nominal 18 wt % solids image-receiving coating mix was prepared at room temperature by introducing 7.13 g of a 10 wt % aqueous solution of poly(vinyl alcohol) (CELVOL® 540, Sekisui) into a mixing vessel and agitating. To this mix, 41.00 g of an alumina mix prepared according to the procedure of Example 1, 0.66 g of a 10 wt % aqueous solution of a 40% fluoroacrylic alcohol substituted polyethylene in water (ZONYL® FS-300, DuPont), and 1.00 g of deionized water were added. The resulting image-receiving layer coating mix had an inorganic particle to polymer weight ratio of 92:8.

Image-Receiving Layer Coated Films

Image-Receiving layer coated films were prepared from these under-layer coated substrates and this image-receiving layer coating mix according to the procedure of Example 8.

Example 11

Preparation of Under-Layer Coated Substrates

Under-layer coated substrates were prepared according to the procedure of Example 10.

Preparation of Image-Receiving Layer Coating Mix

An nominal 18 wt % solids image-receiving coating mix was prepared at room temperature by introducing 7.13 g of a 10 wt % aqueous solution of poly(vinyl alcohol) (CELVOL® 540, Sekisui) into a mixing vessel and agitating. To this mix, 41.00 g of an alumina mix prepared according to the procedure of Example 1, 0.80 g of a 10 wt % aqueous solution of a 40% fluoroacrylic alcohol substituted polyethylene in water (ZONYL® FS-300, DuPont), and 0.86 g of deionized water were added. The resulting image-receiving layer coating mix had an inorganic particle to polymer weight ratio of 92:8.

Image-Receiving Layer Coated Films

Image-Receiving layer coated films were prepared from these under-layer coated substrates and this image-layer receiving coating mix according to the procedure of Example 8.

Example 12

Preparation of Under-Layer Coated Substrates

Under-layer coated substrates were prepared according to the procedure of Example 9.

Image-Receiving Layer Coated Films

Image-Receiving layer coated films were prepared from these under-layer coated substrates according to the procedure of Example 10.

Example 13

Preparation of Under-Layer Coated Substrates

Under-layer coated substrates were prepared according to the procedure of Example 9.

Image-Receiving Layer Coated Films

Image-Receiving layer coated films were prepared from these under-layer coated substrates according to the procedure of Example 11.

Example 14

Preparation of Under-Layer Coated Substrates

Under-layer coated substrates were prepared according to the procedure of Example 8.

Image-Receiving Layer Coated Films

Image-Receiving layer coated films were prepared from these under-layer coated substrates according to the procedure of Example 10.

Example 15

Preparation of Under-Layer Coated Substrates

Under-layer coated substrates were prepared according to the procedure of Example 8.

Image-Receiving Layer Coated Films

Image-Receiving layer coated films were prepared from these under-layer coated substrates according to the procedure of Example 11.

Example 16

The coated films of Examples 8-15 were evaluated as described above, by ink-jet printing at 88-89% relative humidity. Results are summarized in Table II.

The absence of surfactant from both the under-layer and image-receiving layer was associated with the worst drying performance. The presence of surfactant at these levels in the image-receiving layer was associated with the best drying performance, regardless of the presence or absence of surfactant in the under-layer. Where surfactant was absent from the image-receiving layer, the presence of surfactant in the under-layer at these levels was associated with better drying performance relative to films where surfactant was absent from the under-layer.

The presence of surfactant at these levels in either the under-layer or the image-receiving layer was associated with high haze values. The sample with surfactant in only the under-layer had a lower haze value than the samples with surfactant in only the image-receiving layer. The sample without surfactant had the lowest haze value.

Example 17

Preparation of Under-Layer Coating Mix

A master batch and an under-layer coating mix were prepared according to the procedure of Example 1.

Preparation of Under-Layer Coated Substrates

Under-layer coated substrates were prepared from this under-layer coating mix according to the procedure of Example 1. The resulting under-layer coatings had 6.30 wt % solids and a weight ratio of borax to gelatin of 0.45:1.

Preparation of Image-Receiving Layer Coating Mix

An nominal 18.3 wt % solids image-receiving coating mix was prepared at room temperature by introducing 7.13 g of a 10 wt % aqueous solution of poly(vinyl alcohol) (CELVOL® 540, Sekisui) into a mixing vessel and agitating. To this mix, 41.00 g of an alumina mix prepared according to the procedure of Example 1, 0.66 g of a 30% solids perfluoro methacrylic copolymer aqueous dispersion (ZONYL® 8740, DuPont), and 1.00 g of deionized water were added. The resulting image-receiving layer coating mix had an inorganic particle to polymer weight ratio of 92:8.

Preparation of Image-Receiving Layer Coated Films

The nominal 18.3 wt % solids image-receiving layer coating mix was knife-coated at room temperature onto the under-layer coated substrates, using a coating gap of 12 mils. The coated films were dried at 50° C. for 10 min in a Blue M Oven.

Example 18

The procedure of Example 17 was replicated.

Example 19

Preparation of Under-Layer Coating Mix

To a 19.71 g aliquot of the master batch of Example 17, 0.29 g of a 30% solids perfluoro methacrylic copolymer aqueous dispersion (ZONYL® 8740, DuPont) was added. A homogeneous mixture could not be made.

Example 20

Preparation of Under-Layer Coating Mix

To a 19.71 g aliquot of the master batch of Example 17, 0.29 g of a 10 wt % aqueous solution of nonyl phenol, glycidyl polyether (Surfactant 10G, Dixie) was added and mixed well. This mix was maintained at 40° C. for coating.

Preparation of Under-Laver Coated Substrates

Under-layer coated substrates were prepared from this under-layer coating mix according to the procedure of Example 1. The resulting under-layer coatings had 6.44 wt % solids and a weight ratio of borax to gelatin of 0.45:1.

Preparation of Image-Receiving Layer Coated Films

Image-Receiving layer coated films were prepared from these under-layer coated substrates according to the procedure of Example 17.

Example 21

Preparation of Under-Layer Coating Mix

To a 19.71 g aliquot of the master batch of Example 17, 0.58 g of a 10 wt % aqueous solution of nonyl phenol, glycidyl polyether (Surfactant 10G, Dixie) was added and mixed well. This mix was maintained at 40° C. for coating.

Preparation of Under-Layer Coated Substrates

Under-layer coated substrates were prepared from this under-layer coating mix according to the procedure of Example 1. The resulting under-layer coatings had 6.51 wt % solids and a weight ratio of borax to gelatin of 0.45:1.

Preparation of Image-Receiving Layer Coated Films

Image-Receiving layer coated films were prepared from these under-layer coated substrates according to the procedure of Example 17.

Example 22

Preparation of Under-Layer Coated Substrates

Under-layer coated substrates were prepared according to the procedure of Example 20.

Preparation of Image-Receiving Layer Coating Mix

An nominal 18 wt % solids image-receiving coating mix was prepared at room temperature by introducing 7.13 g of a 10 wt % aqueous solution of poly(vinyl alcohol) (CELVOL® 540, Sekisui) into a mixing vessel and agitating. To this mix, 41.00 g of an alumina mix prepared according to the procedure of Example 1 and 1.66 g of deionized water were added. The resulting image-receiving layer coating mix had an inorganic particle to polymer weight ratio of 92:8.

Preparation of Image-Receiving Layer Coated Films

The nominal 18 wt % solids image-receiving layer coating mix was knife-coated at room temperature onto the under-layer coated substrates, using a coating gap of 12 mils. The coated films were dried at 50° C. for 10 min in a Blue M Oven.

Example 23

Preparation of Under-Layer Coated Substrates

Under-layer coated substrates were prepared according to the procedure of Example 21.

Preparation of Image-Receiving Layer Coated Films

Image-receiving layer coated films were prepared from these under-layer coated substrates according to the procedure of Example 22.

Example 24

The coated films of Examples 17-23 were evaluated as described above, by ink-jet printing at 87-88% relative humidity. Samples 17-1, 18-1, 20-1, 21-1, 22-1, and 23-1 were printed and evaluated as a group. Several days later, Samples 17-2, 18-2, 19-2, 20-2, 21-2, 22-2, and 23-2 were printed and evaluated as a group. Results are summarized in Table III.

As noted in Experiment 19, ZONYL® 8740 at these levels could not be used to make a homogeneous under-layer. ZONYL® 8740 was therefore used only as an image-receiving layer surfactant, while Surfactant 10G was instead used as an under-layer surfactant.

The presence of ZONYL® 8740 at these levels in the image-receiving layer was associated with the worst drying performance, while the absence of ZONYL® 8740 in the image-receiving layer was associated with the best drying performance.

The presence of Surfactant 10G at these levels in the under-layer was associated with the best drying performance, while the absence of Surfactant 10G in the under-layer was associated with the worst drying performance.

The presence of ZONYL® 8740 at these levels in the image-receiving layer was associated with the lowest haze values, while the absence of ZONYL® 8740 in the image-receiving layer was associated with the highest haze values.

The presence of Surfactant 10G at these levels in the under-layer was associated with increased haze values, with haze values increasing with increasing Surfactant 10G levels.

Where ZONYL® 8740 was also present in the image-receiving layer, haze values were lower than samples without ZONYL® 8740 in the image-receiving layer.

Example 25

Preparation of Under-Layer Coating Mix

A master batch and an under-layer coating mix were prepared according to the procedure of Example 1.

Preparation of Under-Layer Coated Substrates

Under-layer coated substrates were prepared a from this under-layer coating mix according to the procedure of Example 1. The resulting under-layer coatings had 6.30 wt % solids and a weight ratio of borax to gelatin of 0.45:1.

Preparation of Image-Receiving Layer Coating Mix

An nominal 18.2 wt % solids image-receiving coating mix was prepared at room temperature by introducing 7.13 g of a 10 wt % aqueous solution of poly(vinyl alcohol) (CELVOL® 540, Sekisui) into a mixing vessel and agitating. To this mix, 41.00 g of an alumina mix prepared according to the procedure of Example 1, 0.66 g of a 20% fluoroaliphatic copolymer in 7% dipropyl glycol and 73% water (MASURF® FP-420, Mason Chemical), and 1.00 g of deionized water were added. The resulting image-receiving layer coating mix had an inorganic particle to polymer weight ratio of 92:8.

Preparation of Image-Receiving Layer Coated Films

The nominal 18.2 wt % solids image-receiving layer coating mix was knife-coated at room temperature onto the under-layer coated substrates, using a coating gap of 12 mils. The coated films were dried at 50° C. for 10 min in a Blue M Oven.

Example 26

The procedure of Example 25 was replicated.

Example 27

Preparation of Under-Layer Coating Mix

To a 19.71 g aliquot of the master batch of Example 25, 0.29 g of a 20% fluoroaliphatic copolymer in 7% dipropyl glycol and 73% water (MASURF® FP-420, Mason Chemical) was added and mixed well. This mix was maintained at 40° C. for coating.

Preparation of Under-Layer Coated Substrates

Under-layer coated substrates were prepared a from this under-layer coating mix according to the procedure of Example 1. The resulting under-layer coatings had 6.59 wt % solids and a weight ratio of borax to gelatin of 0.45:1.

Preparation of Image-Receiving Layer Coated Films

Image-receiving layer coated films were prepared from these under-layer coated substrates according to the procedure of Example 25.

Example 28

Preparation of Under-Layer Coating Mix

To a 19.71 g aliquot of the master batch of Example 25, 0.58 g of a 20% fluoroaliphatic copolymer in 7% dipropyl glycol and 73% water (MASURF® FP-420, Mason Chemical) was added and mixed well. This mix was maintained at 40° C. for coating.

Preparation of Under-Layer Coated Substrates

Under-layer coated substrates were prepared from this under-layer coating mix according to the procedure of Example 1. The resulting under-layer coatings had 6.78 wt % solids and a weight ratio of borax to gelatin of 0.45:1.

Preparation of Image-Receiving Layer Coated Films

Image-receiving layer coated films were prepared from these under-layer coated substrates according to the procedure of Example 25.

Example 29

Preparation of Under-Layer Coated Substrates

Under-layer coated substrates were prepared according to the procedure of Example 27.

Preparation of Image-Receiving Layer Coating Mix

An nominal 17.9 wt % solids image-receiving coating mix was prepared at room temperature by introducing 7.13 g of a 10 wt % aqueous solution of poly(vinyl alcohol) (CELVOL® 540, Sekisui) into a mixing vessel and agitating. To this mix, 41.00 g of an alumina mix prepared according to the procedure of Example 1 and 1.66 g of deionized water were added. The resulting image-receiving layer coating mix had an inorganic particle to polymer weight ratio of 92:8.

Preparation of Image-Receiving Layer Coated Films

The nominal 17.9 wt % solids image-receiving layer coating mix was knife-coated at room temperature onto the under-layer coated substrates, using a coating gap of 12 mils. The coated films were dried at 50° C. for 10 min in a Blue M Oven.

Example 30

Preparation of Under-Layer Coated Substrates

Under-layer coated substrates were prepared according to the procedure of Example 28.

Preparation of Image-Receiving Layer Coated Films

Image-receiving layer coated films were prepared from these under-layer coated substrates according to the procedure of Example 29.

Example 31

Preparation of Under-Layer Coated Substrates

Under-layer coated substrates were prepared according to the procedure of Example 25.

Preparation of Image-Receiving Layer Coated Films

Image-receiving layer coated films were prepared from these under-layer coated substrates according to the procedure of Example 29.

Example 32

The procedure of Example 31 was replicated.

Example 33

The coated films of Examples 25-32 were evaluated as described above, by ink-jet printing at 87-88% relative humidity. Results are summarized in Table IV.

In films having no surfactant in the image-receiving layer, the presence of surfactant at intermediate levels in the under-layer was associated with the best drying performance, while either higher levels of surfactant or the absence of surfactant in the under-layer were associated with worsened drying performance. The presence of surfactant at these levels in both the under-layer and image-receiving layer was associated with the worst drying performance.

In films having no surfactant in the under-layer, the presence of surfactant at these levels in the image-receiving layer was associated with better drying performance, while the absence of surfactant from the image-receiving layer was associated with worsened drying performance.

The presence of surfactant at these levels in both the under-layer and the image-receiving layer was associated with the highest haze values, while the absence of surfactant from both the under-layer and image-receiving layer was associated with the lowest haze values. Increasing levels of surfactant in either the under-layer or the image-receiving layer were associated with increased haze values.

Example 34

Preparation of Under-Layer Coating Mix

A master batch and an under-layer coating mix were prepared according to the procedure of Example 1.

Preparation of Under-Layer Coated Substrates

Under-layer coated substrates were prepared from this under-layer coating mix according to the procedure of Example 1. The resulting under-layer coatings had 6.30 wt % solids and a weight ratio of borax to gelatin of 0.45:1.

Preparation of Image-Receiving Layer Coating Mix

An nominal 17.9 wt % solids image-receiving coating mix was prepared at room temperature by introducing 7.13 g of a 10 wt % aqueous solution of poly(vinyl alcohol) (CELVOL® 540, Sekisui) into a mixing vessel and agitating. To this mix, 41.00 g of an alumina mix prepared according to the procedure of Example 1 and 1.66 g of deionized water were added. The resulting image-receiving layer coating mix had an inorganic particle to polymer weight ratio of 92:8.

Preparation of Image-Receiving Layer Coated Films

The nominal 17.9 wt % solids image-receiving layer coating mix was knife-coated at room temperature onto the under-layer coated substrates, using a coating gap of 12 mils. The coated films were dried at 50° C. for 10 min in a Blue M Oven.

Example 35

The procedure of Example 34 was replicated.

Example 36

Preparation of Under-Layer Coating Mix

To a 19.71 g aliquot of the master batch of Example 34, 0.29 g of a 10% aqueous mixture of a hydroxy-terminated fluorinated polyether (PF-159, BASF) was added and mixed well. This mix was maintained at 40° C. for coating.

Preparation of Under-Layer Coated Substrates

Under-layer coated substrates were prepared from this under-layer coating mix according to the procedure of Example 1. Some phase separation occurred in the under-layers as they dried. The resulting under-layer coatings had 6.44 wt % solids and a weight ratio of borax to gelatin of 0.45:1.

Preparation of Image-Receiving Layer Coating Mix

An nominal 18.0 wt % solids image-receiving coating mix was prepared at room temperature by introducing 7.13 g of a 10 wt % aqueous solution of poly(vinyl alcohol) (CELVOL® 540, Sekisui) into a mixing vessel and agitating. To this mix, 41.00 g of an alumina mix prepared according to the procedure of Example 1, 0.66 g of a 10% aqueous solution of a hydroxy-terminated fluorinated polyether (PF-159, BASF), and 1.00 g of deionized water were added. The resulting image-receiving layer coating mix had an inorganic particle to polymer weight ratio of 92:8.

Preparation of Image-Receiving Layer Coated Films

The nominal 18.0 wt % solids image-receiving layer coating mix was knife-coated at room temperature onto the under-layer coated substrates, using a coating gap of 12 mils. The coated films were dried at 50° C. for 10 min in a Blue M Oven.

Example 37

Preparation of Under-Layer Coating Mix

To a 19.71 g aliquot of the master batch of Example 34, 0.58 g of a 10% aqueous solution of a hydroxy-terminated fluorinated polyether (PF-159, BASF) was added and mixed well. This mix was maintained at 40° C. for coating.

Preparation of Under-Layer Coated Substrates

Under-layer coated substrates were prepared from this under-layer coating mix according to the procedure of Example 1. Some phase separation occurred in the under-layers as they dried. The resulting under-layer coatings had 6.50 wt % solids and a weight ratio of borax to gelatin of 0.45:1.

Preparation of Image-Receiving Layer Coated Films

Image-receiving layer coated films were prepared from these under-layer coated substrates according to the procedure of Example 36.

Example 38

Preparation of Under-Layer Coated Substrates

Under-layer coated substrates were prepared according to the procedure of Example 36. Phase separation was again observed in the under-layer coating.

Preparation of Image-Receiving Layer Coated Films

Image-receiving layer coated films were prepared from these under-layer coated substrates according to the procedure of Example 34.

Example 39

Preparation of Under-Layer Coated Substrates

Under-layer coated substrates were prepared according to the procedure of Example 37. Phase separation was again observed in the under-layer coating.

Preparation of Image-Receiving Layer Coated Films

Image-receiving layer coated films were prepared from these under-layer coated substrates according to the procedure of Example 34.

Example 40

Preparation of Under-Layer Coated Substrates

Under-layer coated substrates were prepared according to the procedure of Example 34.

Preparation of Image-Receiving Layer Coated Films

Image-receiving layer coated films were prepared from these under-layer coated substrates according to the procedure of Example 36.

Example 41

The procedure of Example 40 was replicated.

Example 42

The coated films of Examples 34-42 were evaluated as described above, by ink-jet printing at 89-90% relative humidity. Results are summarized in Table V.

As noted in Examples 36-39, the presence of surfactant at these levels in the under-layer was associated with phase separation in the under-layer coating.

The presence of surfactant at these levels in the under-layer was associated with the best drying performance, while the absence of surfactant in the under-layer was associated with the worst drying performance. However, as noted in Examples 36-39, the presence of surfactant at these levels in the under-layer was also associated with phase separation in the under-layer coating.

The presence of surfactant at these levels in the image-receiving layer alone was associated with only modest improvements in drying performance.

The presence of surfactant at these levels in both the under-layer and image-receiving layer was associated with the highest haze values, while the absence of surfactant in the under-layer and image-receiving layer was associated with the lowest haze values. Increasing surfactant levels in the under-layer layer were associated with increased haze values.

Example 43

Preparation of Under-Layer Coating Mix

A master batch and an under-layer coating mix were prepared according to the procedure of Example 1.

Preparation of Under-Layer Coated Substrates

Under-layer coated substrates were prepared from this under-layer coating mix according to the procedure of Example 1. The resulting under-layer coatings had 6.30 wt % solids and a weight ratio of borax to gelatin of 0.45:1.

Preparation of Image-Receiving Layer Coating Mix

An nominal 17.9 wt % solids image-receiving coating mix was prepared at room temperature by introducing 7.13 g of a 10 wt % aqueous solution of poly(vinyl alcohol) (CELVOL® 540, Sekisui) into a mixing vessel and agitating. To this mix, 41.00 g of an alumina mix prepared according to the procedure of Example 1 and 1.66 g of deionized water were added. The resulting image-receiving layer coating mix had an inorganic particle to polymer weight ratio of 92:8.

Preparation of Image-Receiving Layer Coated Films

The nominal 17.9 wt % solids image-receiving layer coating mix was knife-coated at room temperature onto the under-layer coated substrates, using a coating gap of 12 mils. The coated films were dried at 50° C. for 10 min in a Blue M Oven.

Example 44

The procedure of Example 43 was replicated.

Example 45

Preparation of Under-Layer Coating Mix

A 10% aqueous dilution of a 40% solution of a non-ionic fluorosurfactant in 30% isopropyl alcohol and 30% water (ZONYL® FSN, DuPont) was prepared. To a 19.71 g aliquot of the master batch of Example 43, 0.29 g of this 10% aqueous dilution was added. This mix was maintained at 40° C. for coating.

Preparation of Under-Layer Coated Substrates

Under-layer coated substrates were prepared a from this under-layer coating mix according to the procedure of Example 1. The resulting under-layer coatings had 6.36 wt % solids and a weight ratio of borax to gelatin of 0.45:1.

Preparation of Image-Receiving Layer Coating Mix

An nominal 18.0 wt % solids image-receiving coating mix was prepared at room temperature by introducing 7.13 g of a 10 wt % aqueous solution of poly(vinyl alcohol) (CELVOL® 540, Sekisui) into a mixing vessel and agitating.

To this mix, 41.00 g of an alumina mix prepared according to the procedure of Example 1, 0.66 g of a 10% aqueous dilution of a 40% solution of a non-ionic fluorosurfactant in 30% isopropyl alcohol and 30% water (ZONYL® FSN, DuPont), and 1.00 g of deionized water were added. The resulting image-receiving layer coating mix had an inorganic particle to polymer weight ratio of 92:8.

Preparation of Image-Receiving Layer Coated Films

The nominal 18.0 wt % solids image-receiving layer coating mix was knife-coated at room temperature onto the under-layer coated substrates, using a coating gap of 12 mils. The coated films were dried at 50° C. for 10 min in a Blue M Oven.

Example 46

Preparation of Under-Layer Coating Mix

A 10% aqueous dilution of a 40% solution of a non-ionic fluorosurfactant in 30% isopropyl alcohol and 30% water (ZONYL® FSN, DuPont) was prepared. To a 19.71 g aliquot of the master batch of Example 43, 0.58 g of this 10% aqueous dilution was added. This mix was maintained at 40° C. for coating.

Preparation of Under-Layer Coated Substrates

Under-layer coated substrates were prepared from this under-layer coating mix according to the procedure of Example 1. The resulting under-layer coatings had 6.32 wt % solids and a weight ratio of borax to gelatin of 0.45:1.

Preparation of Image-Receiving Layer Coated Films

Image-receiving layer coated films were prepared from these under-layer coated substrates according to the procedure of Experiment 45.

Example 47

Preparation of Under-Layer Coated Substrates

Under-layer coated substrates were prepared according to the procedure of Example 45.

Preparation of Image-Receiving Layer Coated Films

Image-receiving layer coated films were prepared from these under-layer coated substrates according to the procedure of Experiment 43.

Example 48

Preparation of Under-Layer Coated Substrates

Under-layer coated substrates were prepared according to the procedure of Example 46.

Preparation of Image-Receiving Layer Coated Films

Image-receiving layer coated films were prepared from these under-layer coated substrates according to the procedure of Experiment 43.

Example 49

Preparation of Under-layer Coated Substrates Under-layer coated substrates were prepared according to the procedure of Example 43.

Preparation of Image-Receiving Layer Coated Films

Image-receiving layer coated films were prepared from these under-layer coated substrates according to the procedure of Experiment 45.

Example 50

Preparation of Under-Layer Coated Substrates

Under-layer coated substrates were prepared according to the procedure of Example 43.

Preparation of Image-Receiving Layer Coating Mix

A nominal 18.0 wt % solids image-receiving coating mix was prepared at room temperature by introducing 7.13 g of a 10 wt % aqueous solution of poly(vinyl alcohol) (CELVOL® 540, Sekisui) into a mixing vessel and agitating. To this mix were added 41.00 g of an alumina mix prepared according to the procedure of Example 1 and 1.66 g of a 10% dilution of a 40% solution of a non-ionic fluorosurfactant in 30% isopropyl alcohol and 30% water (ZONYL® FSN, DuPont). The resulting image-receiving layer coating mix had an inorganic particle to polymer weight ratio of 92:8.

Preparation of Image-Receiving Layer Coated Films

The nominal 18.0 wt % solids image-receiving layer coating mix was knife-coated at room temperature onto the under-layer coated substrates, using a coating gap of 12 mils. The coated films were dried at 50° C. for 10 min in a Blue M Oven.

Example 51

The coated films of Examples 43-50 were evaluated as described above, by ink-jet printing at 81-88% relative humidity. Results are summarized in Table VI.

In films with no surfactant in the under-layer, the presence of surfactant at these levels in the image-receiving layer coating was associated with the best drying performance, while the absence of surfactant in the image-receiving layer coating was associated with the worst drying performance.

In films with no surfactant in the image-receiving layer, the presence of surfactant at these levels in the under-layer was associated with some improved drying performance, with increasing surfactant level in the under-layer being associated with increased drying performance.

In films where surfactant was present at these levels in both the under-layer and the image-receiving layers, increasing surfactant levels was associated with improved drying performance.

The presence of surfactant at these levels in the under-layer was associated with the highest haze values, while the absence of surfactant in both the image-receiving layer and the under-layer was associated with the lowest haze values. Increasing surfactant levels in either the image-receiving layer or the under-layer was associated with increased haze values.

Example 52

Preparation of Under-Layer Coating Mix

A master batch and an under-layer coating mix were prepared according to the procedure of Example 1.

Preparation of Under-Layer Coated Substrates

Under-layer coated substrates were prepared from this under-layer coating mix according to the procedure of Example 1. The resulting under-layer coatings had 6.30 wt % solids and a weight ratio of borax to gelatin of 0.45:1.

Preparation of Image-Receiving Layer Coating Mix

An nominal 17.9 wt % solids image-receiving coating mix was prepared at room temperature by introducing 7.13 g of a 10 wt % aqueous solution of poly(vinyl alcohol) (CELVO®L 540, Sekisui) into a mixing vessel and agitating. To this mix, 41.00 g of an alumina mix prepared according to the procedure of Example 1 and 1.66 g of deionized water were added. The resulting image-receiving layer coating mix had an inorganic particle to polymer weight ratio of 92:8.

Preparation of Image-Receiving Layer Coated Films

The nominal 17.9 wt % solids image-receiving layer coating mix was knife-coated at room temperature onto the under-layer coated substrates, using a coating gap of 12 mils. The coated films were dried at 50° C. for 10 min in a Blue M Oven.

Example 53

Preparation of Under-Layer Coating Mix

To a 19.71 g aliquot of the master batch of Example 52, 0.29 g of a 10 wt % aqueous solution of nonyl phenol, glycidyl polyether (Surfactant 10G, Dixie) was then added and mixed until homogeneous. This mix was maintained at 40° C. for coating.

Preparation of Under-Layer Coated Substrates

Under-layer coated substrates were prepared from this under-layer coating mix according to the procedure of Example 1. The resulting under-layer coatings had 6.46 wt % solids and a weight ratio of borax to gelatin of 0.45:1.

Preparation of Image-Receiving Layer Coated Films

Image-receiving layer coated films were prepared from these under-layer coated substrates according to the procedure of Example 52.

Example 54

Preparation of Under-Layer Coated Substrates

Under-layer coated substrates were prepared according to the procedure of Example 53.

Preparation of Image-Receiving Layer Coating Mix

An nominal 18.0 wt % solids image-receiving coating mix was prepared at room temperature by introducing 7.13 g of a 10 wt % aqueous solution of poly(vinyl alcohol) (CELVOL® 540, Sekisui) into a mixing vessel and agitating. To this mix, 41.00 g of an alumina mix prepared according to the procedure of Example 1, 0.66 g of a 10% aqueous solution of nonyl phenol, glycidyl polyether (Surfactant 10G, Dixie), and 1.00 g of deionized water were added. The resulting image-receiving layer coating mix had an inorganic particle to polymer weight ratio of 92:8.

Preparation of Image-Receiving Layer Coated Films

The nominal 18.0 wt % solids image-receiving layer coating mix was knife-coated at room temperature onto the under-layer coated substrates, using a coating gap of 12 mils. The coated films were dried at 50° C. for 10 min in a Blue M Oven.

Example 55

Preparation of Under-Layer Coated Substrates

Under-layer coated substrates were prepared according to the procedure of Example 53.

Preparation of Image-Receiving Layer Coating Mix

An nominal 18.1 wt % solids image-receiving coating mix was prepared at room temperature by introducing 7.13 g of a 10 wt % aqueous solution of poly(vinyl alcohol) (CELVOL® 540, Sekisui) into a mixing vessel and agitating.

To this mix, 41.00 g of an alumina mix prepared according to the procedure of Example 1, 0.80 g of a 10% aqueous solution of nonyl phenol, glycidyl polyether (Surfactant 10G, Dixie), and 0.86 g of deionized water were added. The resulting image-receiving layer coating mix had an inorganic particle to polymer weight ratio of 92:8.

Preparation of Image-Receiving Layer Coated Films

The nominal 18.1 wt % solids image-receiving layer coating mix was knife-coated at room temperature onto two under-layer coated substrates, using a coating gap of 12 mils. The coated films were dried at 50° C. for 10 min in a Blue M Oven.

Example 56

Preparation of Under-Layer Coated Substrates

Under-layer coated substrates were prepared according to the procedure of Example 53.

Preparation of Image-Receiving Layer Coating Mix

An nominal 18.1 wt % solids image-receiving coating mix was prepared at room temperature by introducing 7.13 g of a 10 wt % aqueous solution of poly(vinyl alcohol) (CELVOL® 540, Sekisui) into a mixing vessel and agitating.

To this mix, 41.00 g of an alumina mix prepared according to the procedure of Example 1, 0.94 g of a 10% aqueous solution of nonyl phenol, glycidyl polyether (Surfactant 10G, Dixie), and 0.72 g of deionized water were added. The resulting image-receiving layer coating mix had an inorganic particle to polymer weight ratio of 92:8.

Preparation of Image-Receiving Layer Coated Films

The nominal 18.1 wt % solids image-receiving layer coating mix was knife-coated at room temperature onto the under-layer coated substrates, using a coating gap of 12 mils. The coated films were dried at 50° C. for 10 min in a Blue M Oven.

Example 57

Preparation of Under-Layer Coated Substrates

Under-layer coated substrates were prepared according to the procedure of Example 52.

Preparation of Image-Receiving Layer Coated Films

Image-receiving layer coated films were prepared from these under-layer coated substrates according to the procedure of Example 56.

Example 58

Preparation of Under-Layer Coated Substrates

Under-layer coated substrates were prepared according to the procedure of Example 52.

Preparation of Image-Receiving Layer Coated Films

Image-receiving layer coated films were prepared from these under-layer coated substrates according to the procedure of Example 54.

Example 59

Preparation of Under-Layer Coated Substrates

Under-layer coated substrates were prepared according to the procedure of Example 52.

Preparation of Image-Receiving Layer Coated Films

Image-receiving layer coated films were prepared from these under-layer coated substrates according to the procedure of Example 55.

Example 60

The coated films of Examples 52-58 were evaluated as described above, by ink-jet printing at 79-83% relative humidity. Results are summarized in Table VII.

The presence of surfactant at these levels in the image-receiving layer, or in both the image-receiving layer and the under-layer, was associated with the best drying performance, while the absence of surfactant from both the image-receiving layer and the under-layer was associated with the worst drying performance. The presence of surfactant at these levels in the under-layer was associated with improved drying performance.

The presence of surfactant at these levels in the image-receiving layer was associated with the highest haze values, while the absence of surfactant from both the image-receiving layer and the under-layer was associated with the lowest haze values. Increasing levels of surfactant in the image-receiving layer was associated with increased haze values.

At lower levels of surfactant in the image-receiving layer, increasing levels of surfactant in the under-layer was associated with increased haze values. However, at higher levels of surfactant in the image-receiving layer, increasing levels of surfactant in the under-layer was associated with decreased haze values.

Example 61

Preparation of Under-Layer Coating Mix

A master batch and an under-layer coating mix were prepared according to the procedure of Example 1.

Preparation of Under-Layer Coated Substrates

Under-layer coated substrates were prepared from this under-layer coating mix according to the procedure of Example 1. The resulting under-layer coatings had 6.30 wt % solids and a weight ratio of borax to gelatin of 0.45:1.

Preparation of Image-Receiving Layer Coating Mix

An nominal 17.9 wt % solids image-receiving coating mix was prepared at room temperature by introducing 7.13 g of a 10 wt % aqueous solution of poly(vinyl alcohol) (CELVOL® 540, Sekisui) into a mixing vessel and agitating. To this mix, 41.00 g of an alumina mix prepared according to the procedure of Example 1 and 1.66 g of deionized water were added. The resulting image-receiving layer coating mix had an inorganic particle to polymer weight ratio of 92:8.

Preparation of Image-Receiving Layer Coated Films

The nominal 17.9 wt % solids image-receiving layer coating mix was knife-coated at room temperature onto the under-layer coated substrates, using a coating gap of 12 mils. The coated films were dried at 50° C. for 10 min in a Blue M Oven.

Example 62

Preparation of Under-Layer Coating Mix

A 25% aqueous dilution of a 40% solution of a non-ionic fluorosurfactant in 30% isopropyl alcohol and 30% water (ZONYL® FSN, DuPont) was prepared. To a 19.71 g aliquot of the master batch of Example 61, 0.58 g of this 10% aqueous dilution was added. This mix was maintained at 40° C. for coating.

Preparation of Under-Layer Coated Substrates

Under-layer coated substrates were prepared from this under-layer coating mix according to the procedure of Example 1. The resulting under-layer coatings had 6.49 wt % solids and a weight ratio of borax to gelatin of 0.45:1.

Preparation of Image-Receiving Layer Coated Films

Image-receiving layer coated films were prepared from these under-layer coated substrates according to the procedure of Experiment 61.

Example 63

Preparation of Under-Layer Coating Mix

A 25% aqueous dilution of a 40% solution of a non-ionic fluorosurfactant in 30% isopropyl alcohol and 30% water (ZONYL® FSN, DuPont) was prepared. To a 19.71 g aliquot of the master batch of Example 61, 0.29 g of this 10% aqueous dilution was added. This mix was maintained at 40° C. for coating.

Preparation of Under-Layer Coated Substrates

Under-layer coated substrates were prepared from this under-layer coating mix according to the procedure of Example 1. The resulting under-layer coatings had 6.44 wt % solids and a weight ratio of borax to gelatin of 0.45:1.

Preparation of Image-Receiving Layer Coating Mix

An nominal 18.0 wt % solids image-receiving coating mix was prepared at room temperature by introducing 7.13 g of a 10 wt % aqueous solution of poly(vinyl alcohol) (CELVOL 540, Sekisui) into a mixing vessel and agitating. To this mix were added 41.00 g of an alumina mix prepared according to the procedure of Example 1, 0.66 g of a 10% dilution of a 40% solution of a non-ionic fluorosurfactant in 30% isopropyl alcohol and 30% water (ZONYL® FSN, DuPont), and 1.00 g of deionized water. The resulting image-receiving layer coating mix had an inorganic particle to polymer weight ratio of 92:8.

Preparation of Image-Receiving Layer Coated Films

The nominal 18.0 wt % solids image-receiving layer coating mix was knife-coated at room temperature onto the under-layer coated substrates, using a coating gap of 12 mils. The coated films were dried at 50° C. for 10 min in a Blue M Oven.

Example 64

Preparation of Under-Layer Coated Substrates

Under-layer coated substrates were prepared according to the procedure of Example 63.

Preparation of Image-Receiving Layer Coating Mix

An nominal 18.1 wt % solids image-receiving coating mix was prepared at room temperature by introducing 7.13 g of a 10 wt % aqueous solution of poly(vinyl alcohol) (CELVOL® 540, Sekisui) into a mixing vessel and agitating. To this mix were added 41.00 g of an alumina mix prepared according to the procedure of Example 1, 0.80 g of a 25% dilution of a 40% solution of a non-ionic fluorosurfactant in 30% isopropyl alcohol and 30% water (ZONYL® FSN, DuPont), and 1.00 g of deionized water. The resulting image-receiving layer coating mix had an inorganic particle to polymer weight ratio of 92:8.

Preparation of Image-Receiving Layer Coated Films

The nominal 18.1 wt % solids image-receiving layer coating mix was knife-coated at room temperature onto the under-layer coated substrates, using a coating gap of 12 mils. The coated films were dried at 50° C. for 10 min in a Blue M Oven.

Example 65

Preparation of Under-Layer Coated Substrates

Under-layer coated substrates were prepared according to the procedure of Example 62.

Preparation of Image-Receiving Layer Coated Films

Image-receiving layer coated films were prepared from these under-layer coated substrates according to the procedure of Example 63.

Example 66

Preparation of Under-Layer Coated Substrates

Under-layer coated substrates were prepared according to the procedure of Example 61.

Preparation of Image-Receiving Layer Coated Films

Image-receiving layer coated films were prepared from these under-layer coated substrates according to the procedure of Example 64.

Example 67

Preparation of Under-Layer Coated Substrates

Under-layer coated substrates were prepared according to the procedure of Example 61.

Preparation of Image-Receiving Layer Coated Films

Image-receiving layer coated films were prepared from these under-layer coated substrates according to the procedure of Example 63.

Example 68

Preparation of Under-Layer Coated Substrates

Under-layer coated substrates were prepared according to the procedure of Example 61.

Preparation of Image-Receiving Layer Coated Films

Image-receiving layer coated films were prepared from these under-layer coated substrates according to the procedure of Example 64.

Example 69

The coated films of Examples 61-68 were evaluated as described above, by ink-jet printing at 87-88% relative humidity. Results are summarized in Table VIII.

The presence of surfactant at these levels in both the under-layer and the image-receiving layers was associated with the best drying performance.

In films with no surfactant in the under-layer, the presence of surfactant at these levels in the image-receiving layer was associated with improved drying performance relative to films where surfactant was absent from the image-receiving layer.

The presence of surfactant at these levels in the under-layer and the image-receiving layer was associated with the highest haze values, while the absence of surfactant from both the under-layer and the image-receiving layer was associated with the lowest haze values. Increasing surfactant levels in either the under-layer or the image-receiving layer was associated with increased haze values.

Experiment 70

In order to compare the effectiveness of surfactants to improve ink-drying performance with minimal adverse impact on film clarity, linear regression was applied to film % haze and wetness value data, with "% haze" being the regressand and "wetness value" being the regressor. The magnitude of the negative slope of the resulting regression line represents the increase in % haze seen when reducing the wetness value by one unit. Slopes with smaller magnitudes reflect smaller haze generation, while more negative slopes reflect greater haze generation, for the same extent of ink-drying improvement. Surfactants exhibiting smaller slope magnitudes are more effective than surfactants with larger (more negative) slope magnitudes.

Wetness values were constructed from wetness percentage data by taking the largest wedge number for the set of completely wet wedges and adding it to the fractional wetness of the adjacent wedge with the next highest wedge number. For example, if wedges 1 and 2 were completely wet and wedge 3 was 25% wet, the wetness value would be 2.25. Or if no wedges were completely wet, but wedge 1 was 75% wet, the wetness value would be 0.75.

Table IX shows the results of regressing data for ZONYL® FS-300 (Examples 8-15), PF-159 (Examples 34-41), Surfactant 10G (Examples 52-59), and ZONYL® FSN (Examples 61-68).

Surfactant 10G showed the best performance, exhibiting a regression slope of −2.2% haze/wetness unit, which was 34% of the slope for PF-159, 18% of the slope for ZONYL® FSN, and 14% of the slope for ZONYL® FS-300. This represents about a three- to eight-fold greater capacity for Surfactant 10G to improve ink-drying performance relative to the capacities of the other surfactants. Moreover, coatings using Surfactant 10G did not exhibit the phase separation seen in coatings comprising PF-159 in the under-layer.

PF-159 showed the second based performance, exhibiting a regression slope of −6.4% haze/wetness unit, which was 52% of the slope for ZONYL® FSN, and 40% of the slope for ZONYL® FS-300. This represents about a two- to three-fold greater capacity for PF-159 to improve ink-drying performance relative to the capacities of ZONYL® FSN and ZONYL® FS-300.

Example 71

Preparation of Under-Layer Coating Mix

To a mixing vessel, 998 parts by weight of demineralized water was introduced. 78 parts of gelatin was added to the agitated vessel and allowed to swell. This mix was heated to 60° C. The mix was then cooled to 46° C. To this mix, 35 parts of borax (sodium tetraborate decahydrate) was added and held for 15 min. To this mix, 120 parts of an aqueous solution of 32.5 wt % sulfonated polystyrene (VERSA-TO 502, AkzoNobel) and 0.2 wt % microbiocide (KATHON® LX, Dow) was added and mixed until homogeneous. The mix was then cooled to 40° C. 26 parts of a 10 wt % aqueous solution of nonyl phenol, glycidyl polyether (Surfactant 10G) and 39 parts demineralized water were then added and mixed until homogeneous. This mix was cooled to room temperature and held to allow disengagement of any gas bubbles prior to use. The weight ratio of borax to gelatin in the resulting under-layer coating mix was 0.45:1.

Preparation of Poly(vinyl alcohol) Mix

A poly(vinyl alcohol) mix was prepared at room temperature by adding 7 parts by weight of poly(vinyl alcohol) (CELVOL® 540) to a mixing vessel containing 93 parts of demineralized water over 10 min with 500 rpm agitation. This mixture was heated to 85° C. and agitated for 30 minutes. The mixture was then allowed to cool to room temperature. Demineralized water was added to make up for water lost due to evaporation.

Preparation of Alumina Mix

An alumina mix was prepared at room temperature by mixing 75.4 parts by weight of a 9.7 wt % aqueous solution of nitric acid and 764.6 parts of demineralized water. To this mix, 360 parts of alumina powder (DISPERAL® HP-14) was added over 30 min. The mix was heated to 80° C. and stirred for 30 min. The mix was cooled to room temperature and held for gas bubble disengagement prior to use.

Preparation of Image-Receiving Layer Coating Mix

An image-receiving coating mix was prepared at room temperature by introducing 470 parts of the alumina mix into a mixing vessel and agitating. The mix was heated to 40° C. To this mix, 175 parts by weight of the 7 wt % aqueous solution of poly(vinyl alcohol) (CELVOL® 540) and 11 parts of a 10 wt % aqueous solution of nonyl phenol, glycidyl polyether (Surfactant 10G) were added. After 30 min, the resulting mixture was cooled to room temperature and held for gas bubble disengagement prior to use.

Preparation of the Coated Film

The under-layer coating mix was applied to a continuously moving polyethylene terephthalate web, to which primer and subbing layers had previously been applied, as described in U.S. Provisional Application No. 61/415,954, filed Nov. 22, 2010, which is hereby incorporated by reference in its entirety. The coated web was dried continuously by moving past perforated plates through which room temperature air flowed. The pressure drop across the perforated plates was in the range of 0.2 to 5 in $H_2O$. The air dew point was in the range of −4 to 12° C. The under-layer dry coating weight was 5.4 g/m$^2$.

The image-receiving layer coating mix was applied to the under-layer coating and dried in a second pass. The coated film was dried continuously by moving past perforated plates through which room temperature air flowed. The pressure drop across the perforated plates was in the range of 0.2 to 5 in $H_2O$. The air dew point was in the range of −4 to 12° C. The image-receiving layer dry coating weight was 48.2 g/m$^2$. No impingement patterning or mud-cracking was seen in the coated film.

The coated film also comprised back-coat layers, as described in U.S. Provisional Application No. 61/490,619, filed May 27, 2011, which is hereby incorporated by reference in its entirety. The overall coated film exhibited a haze value of 40.3%.

Evaluation of Coated Film

Samples of the coated film were evaluated at three sets of temperatures and humidities after equilibrating at these conditions for at least 16 hrs prior to printing. The coated film samples were imaged with an EPSON® 4900 ink-jet printer using a Wasatch Raster Image Processor (RIP). A grey scale image was created by a combination of photo black, light black, light light black, magenta, light magenta, cyan, light cyan, and yellow EPSON® inks that were supplied with the printer. Samples were printed with a 17-step grey scale wedge having a maximum optical density of at least 2.8. as measured by a calibrated X-RITE® Model DTP 41 Spectrophotometer (X-Rite, Inc., Grandville, Mich.) in transmission mode. Immediately after each film sample exited the printer, the ink-jet image was turned over and placed over a piece of white paper. The fraction of each wedge that was wet was recorded by sequential wedge number, with wedge 1 being the wedge having the maximum optical density and wedge 17 being the wedge with the minimum optical density. In general, the higher number wedges dried before the lowest number wedges.

A measure of wetness was constructed by taking the largest wedge number for the set of completely wet wedges and adding to it the fractional wetness of the adjacent wedge with the next higher wedge number. For example, if wedges 1 and 2 were completely wet and wedge 3 was 25% wet, the wetness value would be 2.25. Or if no wedges were completely wet, but wedge 1 was 75% wet, the wetness value would be 0.75.

Table X summarizes the ink-drying results for the coated film samples. The coated film sample printed under the lowest humidity conditions attained a wetness score of 0; that printed under intermediate humidity conditions attained a wetness score of 0.125, and that printed under the highest humidity conditions attained a wetness score of 0.25-0.5.

The invention has been described in detail with reference to particular embodiments, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

TABLE I

| ID | Surf. in Under-Layer (% solids) | Surf. in Image-Receiving Layer (% solids) | Max. Optical Density | Haze | Wetness Percentage |
|---|---|---|---|---|---|
| 1-1 | 0% | 0.73% | 2.990 | 19.7 | Wedge 2 was 25% wet<br>Wedge 3 was 12% wet |
| 1-2 | 0% | 0.73% | 3.008 | 19.7 | Wedge 2 was 50% wet<br>Wedge 3 was 25%wet |
| 2-1 | 0% | 0.73% | 3.054 | 19.5 | Wedge 2 was 50% wet<br>Wedge 3 was 25% wet |
| 2-2 | 0% | 0.73% | 3.052 | 19.5 | Wedge 2 was 50% wet<br>Wedge 3 was 12% wet |
| 3-1 | 2.4% | 0.73% | 3.034 | 20.5 | Wedge 2 was 12% wet |
| 3-2 | 2.4% | 0.73% | 3.056 | 20.5 | Wedge 2 was 75% wet with banding<br>Wedge 3 was 25% wet with banding<br>Defect line on sheet where measured |
| 4-1 | 4.8% | 0.73% | 3.038 | 20.9 | Wedge 2 was 12% wet |
| 4-2 | 4.8% | 0.73% | 3.020 | 20.9 | Wedge 2 was 12-25% wet<br>Wedge 3 was 12% wet |
| 5-1 | 2.4% | 0% | 2.996 | 16.9 | Wedge 1 was 50% wet<br>Wedge 2 was 12% wet<br>Defect line on sheet where measured |
| 5-2 | 2.4% | 0% | 3.051 | 16.9 | Wedge 2 was 75% wet<br>Wedge 3 was 75% wet<br>Wedge 4 was 12-25% wet |
| 6-1 | 4.8% | 0% | 3.099 | 17.7 | Wedge 2 was 33% wet<br>Wedge 3 was 12% wet |
| 6-2 | 4.8% | 0% | 3.055 | 17.7 | Wedge 3 was 75% wet<br>Wedge 4 was 12% wet |

TABLE II

| ID | Surf. in Under-Layer (% solids) | Surf. in Image-Receiving Layer (% solids) | Max. Optical Density | Haze | Wetness Percentage |
|---|---|---|---|---|---|
| 8 | 0% | 0% | 3.043 | 18.2 | Wedge 2 was 50% wet<br>Wedge 3 was 25% wet<br>Wedge 4 was 12% wet |
| 9 | 4.40% | 0% | 3.081 | 26.4 | Wedge 1 was 75% wet<br>Wedge 2 was 50% wet<br>Wedge 3 was 25% wet<br>Wedge 4 was 12% wet |
| 10 | 2.25% | 0.73% | 3.166 | 38.4 | Wedge 1 was 25% wet<br>Wedge 2 was 12% wet<br>Wedge 3 was 0-12% wet |
| 11 | 2.25% | 0.89% | 3.069 | 38.3 | Wedge 1 was 25% wet<br>Wedge 2 was 12% wet<br>Wedge 3 was 0-12% wet |
| 12 | 4.40% | 0.73% | 3.174 | 39.3 | Wedge 1 was 25% wet<br>Wedge 2 was 12% wet<br>Wedge 3 was 0-12% wet |
| 13 | 4.40% | 0.89% | 3.176 | 39.8 | Wedge 1 was 25% wet<br>Wedge 2 was 12% wet<br>Wedge 3 was 0-12% wet |
| 14 | 0% | 0.73% | 3.166 | 33.3 | Wedge 1 was 25% wet<br>Wedge 2 was 12% wet<br>Wedge 3 was 0-12% wet |
| 15 | 0% | 0.89% | 3.167 | 35.1 | Wedge 1 was 25% wet<br>Wedge 2 was 12% wet<br>Wedge 3 was 12% wet |

TABLE III

| ID | Surf. in UL (% solids) | Surf. in IR Layer (% solids) | Max. Optical Density | Haze | Wetness Percentage |
|---|---|---|---|---|---|
| 17-1 | 0% | 2.17% | 3.073 | 13.8 | Wedge 2 was 75% wet<br>Wedge 3 was 50% wet<br>Wedge 4 was 25% wet |
| 17-2 | 0% | 2.17% | 2.986 | 13.8 | Wedge 3 was 88% wet<br>Wedge 4 was 50% wet |
| 18-1 | 0% | 2.17% | 3.042 | 14.2 | Wedge 2 was 75% wet<br>Wedge 3 was 50% wet<br>Wedge 4 was 25% wet |
| 18-2 | 0% | 2.17% | 3.080 | 14.2 | Wedge 4 was 74% wet |
| 20-1 | 2.40% | 2.17% | 3.037 | 14.1 | Wedge 2 was 75% wet<br>Wedge 3 was 50% wet<br>Wedge 4 was 25% wet |
| 20-2 | 2.40% | 2.17% | 3.049 | 14.1 | Wedge 3 was 88% wet<br>Wedge 4 was 50% wet |
| 21-1 | 4.84% | 2.17% | 3.053 | 14.8 | Wedge 2 was 75% wet<br>Wedge 3 was 50% wet<br>Wedge 4 was 12% wet |
| 21-2 | 4.84% | 2.17% | 3.076 | 14.8 | Wedge 2 was 88% wet<br>Wedge 3 was 75% wet<br>Wedge 4 was 50% wet |
| 22-1 | 2.40% | 0% | 3.012 | 15.7 | Wedge 2 was 50% wet<br>Wedge 3 was 25% wet<br>Wedge 4 was 12% wet |
| 22-2 | 2.40% | 0% | 3.049 | 15.7 | Wedge 2 was 88% wet<br>Wedge 3 was 50% wet<br>Wedge 4 was 25% wet |
| 23-1 | 4.84% | 0% | 2.979 | 17.1 | Wedge 2 was 25% wet<br>Wedge 3 was 12% wet |
| 23-2 | 4.84% | 0% | 2.996 | 17.1 | Wedge 2 was 75% wet<br>Wedge 3 was 25% wet<br>Wedge 4 was 12% wet |

TABLE IV

| ID | Surf. in Under-Layer (% solids) | Surf. in Image-Receiving Layer (% solids) | Max. Optical Density | Haze | Wetness Percentage |
|---|---|---|---|---|---|
| 25 | 0% | 1.46% | 3.010 | 18.4 | Wedge 2 was 75% wet<br>Wedge 3 was 50% wet<br>Wedge 4 was 12% wet |
| 26 | 0% | 1.46% | 3.043 | 18.0 | Wedge 2 was 75% wet<br>Wedge 3 was 50% wet<br>Wedge 4 was 12% wet |
| 27 | 4.40% | 1.46% | 3.076 | 20.1 | Wedge 3 was 50% wet<br>Wedge 4 was 12% wet |
| 28 | 8.44% | 1.46% | 3.049 | 21.9 | Wedge 3 was 50% wet<br>Wedge 4 was 12% wet |
| 29 | 4.40% | 0% | 2.981 | 17.0 | Wedge 2 was 50% wet<br>Wedge 3 was 25% wet<br>Wedge 4 was 12% wet |
| 30 | 8.44% | 0% | 3.032 | 19.0 | Wedge 3 was 50% wet<br>Wedge 4 was 12% wet |
| 31 | 0% | 0% | 3.035 | 13.6 | Wedge 3 was 25% wet<br>Wedge 4 was 12% wet |
| 32 | 0% | 0% | 3.009 | 13.4 | Wedge 3 was 25% wet<br>Wedge 4 was 12% wet |

TABLE V

| ID | Surf. in Under-Layer (% solids) | Surf. in Image-Receiving Layer (% solids) | Max. Optical Density | Haze | Wetness Percentage |
|---|---|---|---|---|---|
| 34 | 0% | 0% | 2.988 | 13.3 | Wedge 2 was 75% wet<br>Wedge 3 was 25% wet<br>Wedge 4 was 12% wet |

TABLE V-continued

| ID | Surf. in Under-Layer (% solids) | Surf. in Image-Receiving Layer (% solids) | Max. Optical Density | Haze | Wetness Percentage |
|---|---|---|---|---|---|
| 35 | 0% | 0% | 2.997 | 13.7 | Wedge 2 was 75% wet<br>Wedge 3 was 25% wet<br>Wedge 4 was 12% wet |
| 36 | 2.25% | 0.73% | 3.054 | 26.9 | Wedge 1 was 75% wet<br>Wedge 2 was 25% wet<br>Wedge 3 was 12% wet |
| 37 | 4.40% | 0.73% | 3.017 | 25.6 | Wedge 1 was 50% wet<br>Wedge 2 was 25% wet<br>Wedge 3 was 12% wet |
| 38 | 2.25% | 0% | 3.008 | 20.9 | Wedge 1 was 50% wet<br>Wedge 2 was 25% wet<br>Wedge 3 was 12% wet |
| 39 | 4.40% | 0% | 2.437* | 20.6 | Wedge 1 was 50% wet<br>Wedge 2 was 25% wet<br>Wedge 3 was 12% wet |
| 40 | 0% | 0.73% | 3.077 | 19.4 | Wedge 2 was 25% wet<br>Wedge 3 was 12% wet<br>Wedge 4 was 12% wet |
| 41 | 0% | 0.73% | 3.078 | 19.0 | Wedge 2 was 75% wet<br>Wedge 3 was 25% wet<br>Wedge 4 was 12% wet |

* = defect on Sample 39 made determination of Max. Optical Density difficult

TABLE VI

| ID | Surf. in Under-Layer (% solids) | Surf. in Image-Receiving Layer (% solids) | Max. Optical Density | Haze | Wetness Percentage |
|---|---|---|---|---|---|
| 43 | 0% | 0% | 3.069 | 13.6 | Wedge 4 was 75% wet<br>Wedge 5 was 12% wet |
| 44 | 0% | 0% | 3.022 | 13.6 | Wedge 3 was 75% wet<br>Wedge 4 was 12% wet |
| 45 | 0.09% | 0.30% | 3.101 | 20.0 | Wedge 3 was 75% wet<br>Wedge 4 was 12% wet |
| 46 | 1.81% | 0.30% | 3.088 | 19.5 | Wedge 3 was 50% wet<br>Wedge 4 was 12% wet |
| 47 | 0.09% | 0% | 3.132 | 17.7 | Wedge 4 was 50% wet<br>Wedge 5 was 12% wet |
| 48 | 1.81% | 0% | 3.127 | 17.9 | Wedge 3 was 75% wet<br>Wedge 4 was 25% wet |
| 49 | 0% | 0.30% | 3.119 | 15.9 | Wedge 2 was 75% wet<br>Wedge 3 was 50% wet<br>Wedge 4 was 12% wet |
| 50 | 0% | 0.74% | 3.141 | 20.5 | Wedge 2 was 75% wet<br>Wedge 3 was 50% wet<br>Wedge 4 was 12% wet |

TABLE VII

| ID | Surf. in Under-Layer (% solids) | Surf. in Image-Receiving Layer (% solids) | Max. Optical Density | Haze | Wetness Percentage |
|---|---|---|---|---|---|
| 52 | 0% | 0% | 3.072 | 13.5 | Wedge 4 was 50% wet |
| 53 | 2.42% | 0% | 3.057 | 15.2 | Wedge 3 was 50% wet<br>Wedge 4 was 12% wet |
| 54 | 2.42% | 0.79% | 3.091 | 19.8 | Wedge 1 was 75% wet<br>Wedge 2 was 25% wet<br>Wedge 3 was 12% wet |
| 55 | 2.42% | 0.96% | 3.078 | 19.1 | Wedge 1 was 75% wet<br>Wedge 2 was 25% wet, with banding<br>Wedge 3 was 12% wet, with banding |

TABLE VII-continued

| ID | Surf. in Under-Layer (% solids) | Surf. in Image-Receiving Layer (% solids) | Max. Optical Density | Haze | Wetness Percentage |
|---|---|---|---|---|---|
| | | | | | Defect on line where measured |
| 56 | 2.42% | 1.13% | 3.104 | 19.7 | Wedge 2 was 50% wet<br>Wedge 3 was 25% wet<br>Wedge 4 was 12% wet |
| 57 | 0% | 1.13% | 3.063 | 20.1 | Wedge 1 was 75% wet<br>Wedge 2 was 50% wet<br>Wedge 3 was 25% wet<br>Wedge 4 was 12% wet |
| 58 | 0% | 0.79% | 3.083 | 18.1 | Wedge 1 was 75% wet<br>Wedge 2 was 50% wet<br>Wedge 3 was 25% wet<br>Wedge 4 was 12% wet |
| 59 | 0% | 0.96% | 3.103 | 19.7 | Wedge 2 was 50% wet<br>Wedge 3 was 25% wet<br>Wedge 4 was 12% wet |

TABLE VIII

| ID | Surf. in Under-Layer (% solids) | Surf. in Image-Receiving Layer (% solids) | Max. Optical Density | Haze | Wetness Percentage |
|---|---|---|---|---|---|
| 61 | 0% | 0% | 3.036 | 17.0 | Wedge 2 was 50% wet<br>Wedge 3 was 25% wet<br>Wedge 4 was 12% wet |
| 62 | 4.40% | 0% | 3.025 | 23.9 | Wedge 1 was 50% wet<br>Wedge 2 was 25% wet<br>Wedge 3 was 12-25% wet |
| 63 | 2.25% | 0.73% | 3.081 | 31.7 | Wedge 1 was 25% wet<br>Wedge 2 was 12% wet |
| 64 | 2.25% | 0.89% | 3.125 | 32.7 | Wedge 1 was 25% wet<br>Wedge 2 was 12% wet |
| 65 | 4.40% | 0.73% | 3.068 | 32.1 | Wedge 1 was 25% wet<br>Wedge 2 was 12% wet |
| 66 | 4.40% | 0.89% | 3.126 | 32.3 | Wedge 1 was 25% wet<br>Wedge 2 was 12% wet |
| 67 | 0% | 0.73% | 2.994 | 19.1 | Wedge 1 was 50% wet<br>Wedge 2 was 25% wet<br>Wedge 3 was 12% wet |
| 68 | 0% | 0.89% | 3.054 | 19.1 | Wedge 1 was 50% wet<br>Wedge 2 was 25% wet<br>Wedge 3 was 12% wet |

TABLE IX

| Surfactant | ID | Haze (%) | Wetness Value | Regression Slope (% Haze/ Wetness Unit) |
|---|---|---|---|---|
| ZONYL ® FS-300 | 8 | 18.2 | 1.5 | −16.0 ± 2.1 |
| | 9 | 26.2 | 0.75 | |
| | 10 | 38.4 | 0.25 | |
| | 11 | 38.3 | 0.25 | |
| | 12 | 39.3 | 0.25 | |
| | 13 | 39.8 | 0.25 | |
| | 14 | 33.3 | 0.25 | |
| | 15 | 35.1 | 0.25 | |
| PF-159 | 34 | 13.3 | 1.75 | −6.4 ± 1.9 |
| | 35 | 13.7 | 1.75 | |
| | 36 | 26.9 | 0.75 | |
| | 37 | 25.6 | 0.50 | |
| | 38 | 20.9 | 0.50 | |
| | 39 | 20.6 | 0.50 | |
| | 40 | 19.4 | 1.25 | |
| | 41 | 19.0 | 1.75 | |

TABLE IX-continued

| Surfactant | ID | Haze (%) | Wetness Value | Regression Slope (% Haze/ Wetness Unit) |
|---|---|---|---|---|
| Surfactant 10G | 52 | 13.5 | 3.5 | −2.16 ± 0.42 |
| | 53 | 15.2 | 2.5 | |
| | 54 | 19.8 | 0.75 | |
| | 55 | 19.1 | 0.75 | |
| | 56 | 19.7 | 1.5 | |
| | 57 | 20.1 | 0.75 | |
| | 58 | 18.1 | 0.75 | |
| | 59 | 19.7 | 1.5 | |
| ZONYL ® FSN | 61 | 17.0 | 1.5 | −12.2 ± 4.1 |
| | 62 | 23.9 | 0.5 | |
| | 63 | 31.7 | 0.25 | |
| | 64 | 32.7 | 0.25 | |
| | 65 | 32.1 | 0.25 | |
| | 66 | 32.4 | 0.25 | |
| | 67 | 19.1 | 0.5 | |
| | 68 | 19.1 | 0.5 | |

NOTE:
Tolerances in the Regression Slope column represent standard errors.

TABLE X

| ID | Printing Temperature | Printing Relative Humidity | Maximum Optical Density | Wetness Value |
|---|---|---|---|---|
| 71-1 | 20° C. | 86% | 2.887 | 0.25-0.50 |
| 71-2 | 24° C. | 47% | 2.845 | 0 |
| 71-3 | 30° C. | 73% | 2.932 | 0.125 |

The invention claimed is:

1. A transparent ink jet recording film comprising:

a transparent substrate;

at least one under-layer comprising gelatin and at least one borate or borate derivative; and at least one image-receiving layer disposed on the at least one under-layer, said at least one image-receiving layer comprising at least one inorganic particle, at least one water soluble or water dispersible polymer comprising at least one hydroxyl group, and nitric acid, wherein at least one of the at least one under-layer or the at least one image-receiving layer comprises at least one first surfactant comprising at least one of a nonyl phenol, glycidyl polyether; a fluoroacrylic alcohol substituted polyethylene; a perfluoro methacrylic copolymer; a fluoroaliphatic copolymer; a hydroxy-terminated fluorinated polyether; or a non-ionic fluorosurfactant, and further wherein the at least one image-receiving layer comprises from about 1 to about 2 g/m$^2$ of the at least one first surfactant on a dry basis.

2. The transparent ink-jet recording film according to claim 1, wherein the at least one under-layer and the at least one image-receiving layer both comprise the at least one first surfactant.

3. The transparent ink-jet recording film according to claim 1, further comprising at least one second surfactant comprising at least one of a nonyl phenol, glycidyl polyether; a fluoroacrylic alcohol substituted polyethylene; a perfluoro methacrylic copolymer; a fluoroaliphatic copolymer; a hydroxy-terminated fluorinated polyether; or a non-ionic fluorosurfactant, wherein the at least one first surfactant and the at least one second surfactant are not the same.

4. The transparent ink jet recording film according to claim 3, wherein the at least one under-layer comprises the at least one first surfactant and the at least one image-receiving layer comprises the at least one second surfactant.

5. The transparent ink jet recording film according to claim 1, wherein the at least one first surfactant comprises a nonyl phenol, glycidyl polyether.

6. The transparent ink-jet recording film according to claim 1, wherein the at least one first surfactant comprises a hydroxy-terminated fluorinated polyether.

7. The transparent ink jet recording film according to claim 1, wherein the at least one water soluble or water dispersible polymer comprises poly(vinyl alcohol).

8. The transparent ink-jet recording film according to claim 1, wherein the at least one image-receiving layer comprises a dry coating weight of at least about 46 g/m$^2$.

9. The transparent ink jet recording film according to claim 1, wherein the at least one under-layer comprises from about 0.001 to about 0.60 g/m$^2$ of the at least one first surfactant on a dry basis.

10. The transparent ink-jet recording film according to claim 1, wherein the film exhibits a haze/wetness regression slope less than about 10% haze/wetness unit in magnitude.

11. The transparent ink jet recording film according to claim 1, wherein the film exhibits a haze/wetness regression slope less than about 5% haze/wetness unit in magnitude.

12. The transparent ink-jet recording film according to claim 1, wherein the film exhibits wetness values below about 0.50 when imaged at 86% relative humidity with an ink jet printer at optical densities of at least 2.8.

13. The transparent ink-jet recording film according to claim 1, wherein the film exhibits wetness values below about 0.25 when imaged at 73% relative humidity with an ink-jet printer at optical densities of at least 2.8.

* * * * *